169-46 SR
8/10/76 OR 3,973,631

United States Patent [19]
Hefetz

[11] 3,973,631
[45] Aug. 10, 1976

[54] METHOD AND DEVICE FOR EXTINGUISHING FIRES IN OIL WELLS

[76] Inventor: Uriel Hefetz, P.O. Box 6037, Jerusalem, Israel

[22] Filed: Jan. 31, 1975

[21] Appl. No.: 546,128

[30] Foreign Application Priority Data

Feb. 5, 1974 Israel ..... 44142

[52] U.S. Cl. ..... 169/46; 166/55; 169/69; 251/212; 251/DIG. 3

[51] Int. Cl.[2] ..... E21B 29/00; A62C 3/04

[58] Field of Search ..... 169/43, 46, 69; 166/55, 166/92, 94, 95, 97; 251/212, DIG. 3

[56] References Cited

UNITED STATES PATENTS

| | | | |
|---|---|---|---|
| 1,879,160 | 9/1932 | Fowzer | 169/69 X |
| 3,039,531 | 6/1962 | Scott | 166/97 X |
| 3,716,068 | 2/1973 | Addison | 166/55 X |
| 3,766,979 | 10/1973 | Petrick | 166/55 |

*Primary Examiner*—John J. Love
*Assistant Examiner*—Michael Mar
*Attorney, Agent, or Firm*—Price, Heneveld, Huizenga & Cooper

[57] ABSTRACT

A method and apparatus for extinguishing oil well fires in wells having an inner pipe and an outer pipe separated by an annular space. A plurality of rod-like members as drills are inserted in a common horizontal plane at equal radial spacing through the walls of both the inner and the outer pipes. The drills have interfitting inner ends which, when placed in side-by-side relationship, form a continuous wall equal to the internal cross section of the inner pipe. Accordingly, the inner pipe is closed against the passage of oil or gas therethrough. A valved pipe is inserted through the wall of the outer pipe below the drills to form a communicating passageway. A member is inserted through the valved pipe and into the annular space to gradually fill the space between the inner and outer pipes to form a seal therein against the passage of oil or gas therethrough.

12 Claims, 8 Drawing Figures

METHOD AND DEVICE FOR EXTINGUISHING FIRES IN OIL WELLS

The invention concerns a method for extinguishing fires in underwater or underground oil wells, and a device for carrying out the method.

The oil in wells is generally produced and supplied through two concentric pipes and flows therethrough at great pressure together with large quantities of gases. Since this mixture is extremely inflamable, fires sometimes occur and much effort and money has been expended to find ways for extinguishing these fires quickly without causing too great damage to the installation around and above the well.

All the known methods for extinguishing fires in oil wells are based on the principle to choke the oil and gas supply through the pipes whereby the fire extinguishes itself. Some methods use detonation of the top of the pipes to carry out this principle while in another method a bore is made at an angle to the wells and mud and liquids are inserted therein so that the ascent of the oil is prevented in the pipes.

While the fire is extinguished in all these known methods the flow of oil must be halted, so that it will be possible to rehabilitate the oil well and its installation for further oil production. Furthermore, all the known methods are time consuming and expensive, since time is of the essence, owing to the fact that astronomic sums are wasted when a well burns and the losses of revenue are great until a well can be made to produce again.

It is the object of the present invention to provide an extremely quick method for choking off the oil supply to the top of the pipes without either destroying the pipes or the oil producing installation, so that if it is desired the production of oil can be immediately continued.

The invention consists in a method of extinguishing fires in oil wells comprising the steps of: a. Inserting at least three drills or spikes at equal radial distances in the wall of the outer oil producing pipe to center the inner oil producing pipe and leaving the drills in place; b. continuing drilling with the same drills or spikes to extend through the wall of the inner oil producing pipe, the bit tips of the drills or spikes being of such angles that their sum is equal to 360° and their diameter or width being of such dimensions that they form chords which extend over the entire inner circumference of the inner pipe and leaving the drills or spikes in place, whereby the interior of the inner pipe is covered; c. attaching a pipe which includes a valve off-center to the outer pipe and below the said drills or spikes, and providing a bore in the wall of the outer pipe through said off-center pipe; d. inserting means for closing the annular space between the two oil producing pipes through said off-center pipe.

In a preferred embodiment of the invention, further drills or spikes are inserted through the wall of the outer oil producing pipe up to the inner oil producing pipe and are left in place therein, the number of drills or spikes corresponding to those of step (a) and being spaced therefrom by a vertical distance larger than said annular distance, the said offcenter pipe being provided midway between these drills or spikes and those of step (a).

It is, of course, understood that in order to apply the aforementioned method, the outer oil producing pipe must at first be exposed, i.e. all the protective casings which normally surround this pipe must be removed before the method can be applied.

The invention further consists in a device for carrying out the method, comprising at least three drills or spikes, the sum of the angles of their tips being 360°, their diameter or width equal to the length of chords obtained by dividing the inner circumference of the inner pipe by the number of drills or spikes and drawing chords between the points on the circumference, a pipe including a valve being adapted to be attached to the outer oil producing pipe and means adapted to be inserted through the pipe for closing the annular space between the inner and outer oil producing pipes.

The means for closing the annular space between the inner and outer oil producing pipes may be a coil spring or a leaf spring, or spheres or bodies of any suitable shape and size.

In a preferred embodiment of the invention, the drills the operating means and the pipe including the valve are mounted on two flanged half-shells, of a diameter corresponding to the external diameter of the outer pipe, the flanges of the shells being adapted to be connected to each other.

The invention is illustrated, by way of example only, in the accompanying drawings, wherein.

Figure 1:
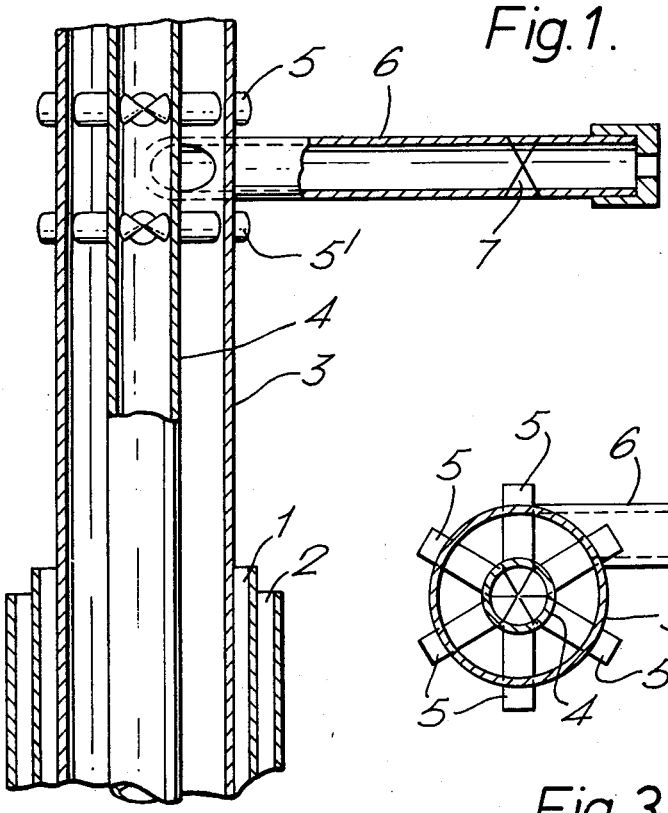
FIG. 1 is a schematic sectional elevation of a section of an oil well, provided with parts of the device according to the invention.
Figure 2:
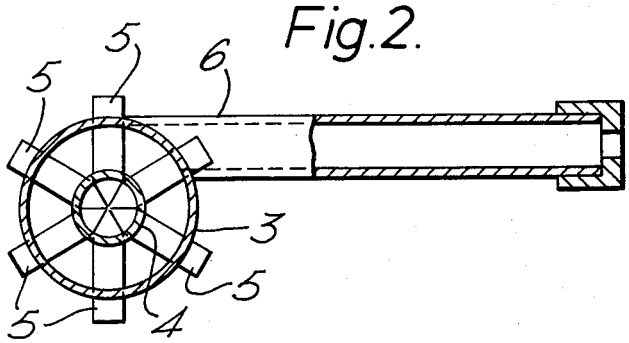
FIG. 2 is a schematic plan view illustrating the means for closing the inner oil producing pipe.
Figure 8:
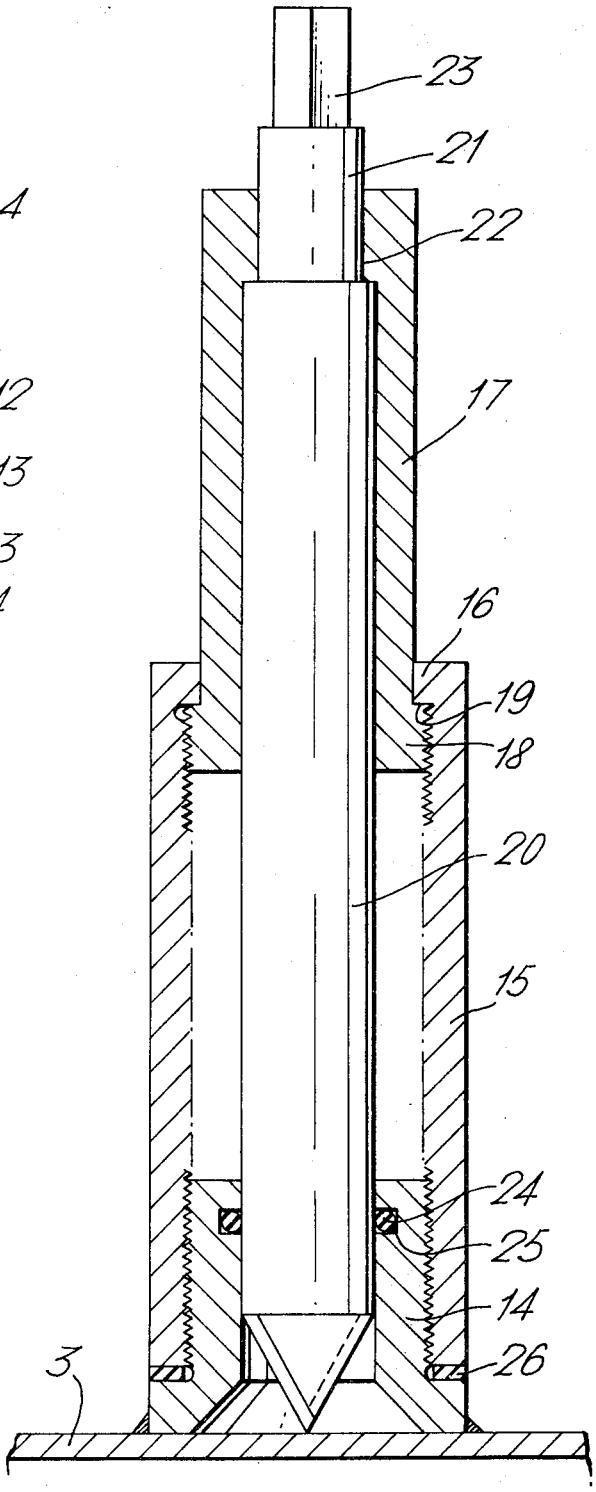
FIG. 8 shows a schematic cross-section of a drill arrangement used to drill the pipes.

According to the invention and as shown in FIG. 1, the protective casings 1 and 2, which surround the outer oil producing pipe 3, are removed. Since the inner oil producing pipe 4 may be located in any axial position within pipe 3, it is first necessary to center pipe 4 in pipe 3. This is effected in that a plurality of drills 5 of a construction which will be explained hereinafter, with reference to FIG. 8, are attached to the outer pipe by welding or in any other suitable manner. In the case here illustrated six such drills 5 are used and are attached to pipe 3 at equal radial distances. The pipe 3 is drilled by means of these drills 5 by operating one after another, the drill being marked on the outside to show that it is inserted for a given distance, i.e. the distance required to center pipe 4.

After the drill holes are made in pipe 3 and pipe 4 is centered therein, drilling is continued to penetrate the wall of pipe 4. Each drill bit has a tip of 60° in this case and the diameter of each drill is such that it forms a chord with the inner circumference of the pipe 4. Thus, six chords of equal length are formed. The drill tips 5 thus will cover the surface of the inner pipe 4 completely.

After these six holes have been drilled, a second set of six holes is made in outer pipe 3 by drills 5' which are attached and operated in a manner similar to drills 5.

The holes made by drills 5 and 5' are vertically aligned and are spaced from each other for a vertical distance greater than the annular distance between the two pipes 3 and 4, i.e. the distance must be greater than the annular distance plus the diameter of a drill, in case a coil spring is used, as will be described hereinafter.

The drills 5' may be driven in only up to and abutting the pipe 4, if desired, or may penetrate pipe 4 in a manner similar to drills 5.

An elongated pipe 6 is attached to pipe 3 midway between drills 5 and 5', a hole being drilled into pipe 3 so that communication between its interior and pipe 6 is obtained. Pipe 6 is provided with a valve 7 so that after the drill is removed the pipe can be shut off.

Figure 3:
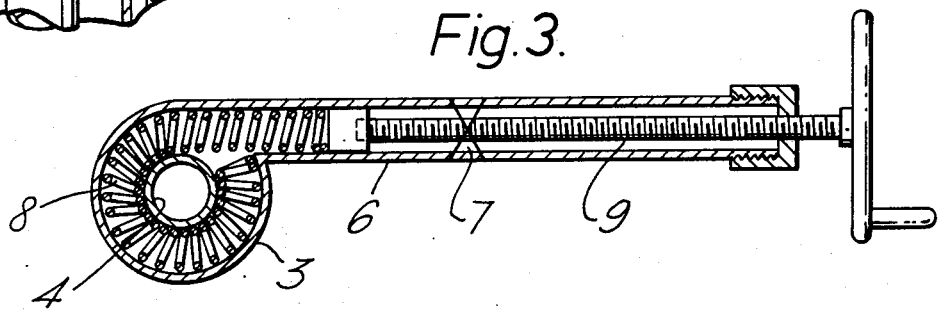
FIG. 3 is a schematic plan view showing the means for closing the annular space between the two oil producing pipes.

In the embodiment shown in FIG. 3 a coil spring 8 is inserted into pipe 6 and is forced by screw means 9 or any other suitable hydraulic or mechanical means through pipe 6 and into the annular space between pipes 3 and 4, the drills 5 and 5' acting as guide means herein so that the spring can not divert from its annular path. Thus, the annular space is practically closed and the oil supply is choked.

If desired and in order to provide a tighter seal, elastic material such as natural or synthetic rubber, plastics or the like is cast around the spring 8 so that the latter is embedded therein. Thus, when the links of the spring are pressed onto each other the elastic material will bulge outward and fill the entire annular space applying itself to both the inner wall of the outer pipe and the outer wall of the inner pipe.

Figure 4:
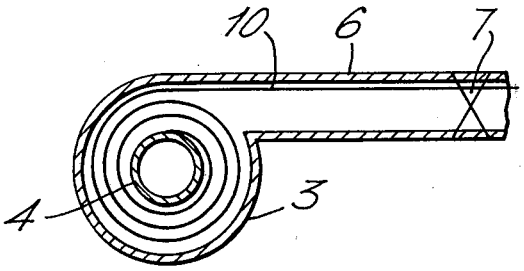
FIGS. 4 and 5 show schematic plan views of two further embodiments of the means for closing the annular space between the two oil producing pipes.

Instead of coil spring 8 a leaf spring 10 (FIG. 4) may be inserted through pipe 6. This leaf spring is destined to apply itself against the inner wall of pipe 3 and upon being forced continuously inwards will slowly wind itself into a spiral until the forward end is applied against the outer wall of pipe 4.

Figure 5:
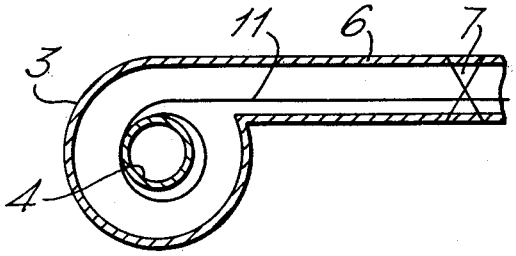

In FIG. 5 is shown another embodiment in which a leaf spring 11 is used which is preformed to apply itself against the outside wall of the inner pipe when it is inserted into the annular space between the two pipes through pipe 6. As the spring 11 is forced inwards it will wind itself in such a manner that it will fill the annular space between the two pipes completely.

Figure 6:
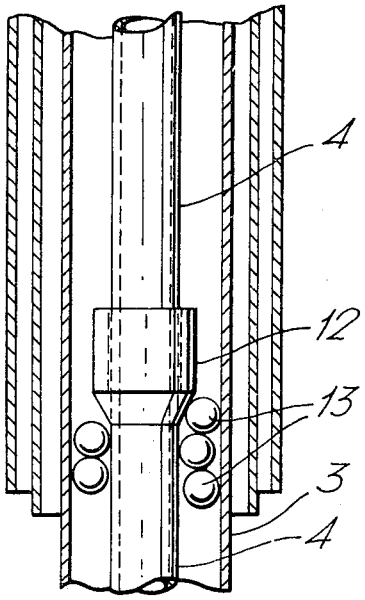
FIGS. 6 and 7 show in schematic elevation and plan, respectively, a further embodiment of the means for closing the annular space between the two oil producing pipes.
Figure 7:
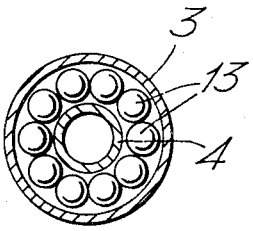

In a modification of the invention shown in FIGS. 6 and 7, a set of holes by means of drills 5 is made in the manner above described to close inner pipe 4 below the joint sleeve 12 of the conventional connection between two sections of inner pipe 4.

Furthermore, a pipe 6 with valve 7 is likewise attached in the manner above described below said joint sleeve 12. In this embodiment, the already centered annular space is sealed off in the following manner: a plurality of spheres 13 of hard material, i.e. steel, of a diameter greater than the space between the connector 12 and the outer pipe 3 but smaller than the annular distance between the pipes, is inserted through pipe 6 into the annular space. These spheres are pushed upward by the pressure of the oil and gases against the connector 12. Thereafter other spheres or bodies of hard or elastic material of different sizes and shapes are inserted through pipe 6 and owing to the pressure will assume a haphazard position whereby the annular space is completely sealed. If desired, the drills or spikes themselves may form the stop for balls or bodies, above described, these balls or bodies being inserted through pipe 6 below said drills or spikes.

It is possible according to the invention to attach a further pipe (not shown) closed by a valve and provided with a line to the shore to pipe 3 at a substantial distance below the drillings above described and to drill through pipes 3 and 4. After the drill is removed while the valve is being closed, and thereafter opening the valve, this pipe is used on the one hand, to relieve the pressure within the pipes 3 and 4 and on the other, to serve as alternative supply pipe so that even during the process of closing the pipes 3 and 4 the oil well need not be killed but can be used as a producing well.

This additional supply pipe will also operate during the rehabilitation of the well and its installation.

The drills herein used comprise, as illustrated in FIG. 8, a short sleeve 14 which is welded to the wall of the outer pipe 3. The outer surface of the sleeve 14 is threaded and is engaged by means of an internally threaded elongated bushing 15 having an outer reduced section or collar 16. Bushing 15 may also be welded to sleeve 14.

A further sleeve 17 whose outer surface may be knurled and whose inner end 18 is enlarged by an external collar 19, threadingly engages with this collar 19 the thread of bushing 15. The drill bit or spike 20 has a reduced shank 21, with which it extends through an internal collar 22 of sleeve 17, the end 23 of shank 21 being shaped in order to be adapted to be engaged by a ratchet wrench or the like (not shown).

An O-ring 24 is provided in a groove 25 in sleeve 14 to seal the drill as it moves inwards, while a packing 26 provides a seal between bushing 15 and sleeve 14 in the case of their threaded attachment. As drill 20 is manually or mechanically rotated it is pressed inward by the successive manual or mechanical rotation of sleeve 17 and is thereby held tightly in position so that the drilling of a hole can easily be performed.

The construction of the drills may be different from that described with reference to FIG. 8; in fact, the drills may be of any known suitable construction.

For easy and quick operation of the device in situ according to the invention, it is possible to mount drills 5 and 5', i.e. sleeves 14 and the parts attached thereto, and pipe 6 onto two half shells of an internal diameter corresponding to the outer diameter of pipe 3 and to provide integral flanges at the end of each half shell so that when these half shells are applied to the outer pipe 3 they may be connected to each other by bolts or the like extending through said flanges before the drilling operation is started.

If desired, the aforementioned additional supply pipe may be attached to the same half shells or to an additional set of half shells which are attached to pipe 3 below the one carrying the drills 5 and 5' and pipe 6.

I claim:

1. A method of extinguishing fires in oil wells having an inner pipe and an outer pipe separated by an annular space comprising the steps of:

a. inserting a plurality of drills at equal radial distances in the wall of the outer pipe to center the inner pipe;

b. continuing drilling with said drills to extend through the wall of the inner pipe, the bit tips of the drills being of such angles that their sum is equal to 360° and their diameter being of such dimensions that they form chords which extend over the entire inner circumference of the inner pipe whereby the interior of the inner pipe is covered;

c. attaching an offset pipe which includes a valve to extend outwardly from the outer pipe and below the drills;

d. providing through said offset pipe a bore in the wall of the outer pipe and e. inserting means for closing the annular space between the inner pipe and the outer pipe through said offset pipe.

2. The method of claim 1, and further including the steps of attaching a second offset pipe adapted to be closed by a valve to the wall of the outer pipe a substantial distance below said first mentioned offset pipe.

3. The method of claim 1 and further including the steps of inserting a second plurality of drills through the walls of the outer pipe up to the inner pipe, the second drills being positioned below said offset pipe; extending the second drills through the wall of the inner pipe to close the interior of the inner pipe; the means for closing the annular space between the inner and the outer pipe being inserted between said first drills and said second drills.

4. The method of claim 3, wherein said second drills are spaced from said first drills by a vertical distance corresponding generally to the thickness of the means for closing the annular space between the inner and outer pipes.

5. The method of claim 1 and further including the step of introducing a plurality of spheres of hard material through the offset pipe of step (c) into said annular space.

6. Apparatus for extinguishing fires in oil wells having an inner pipe and an outer pipe separated by an annular space comprising:

a plurality of rod-like members adapted for insertion through the wall of said outer pipe to center said inner pipe and to extend through the wall of said inner pipe collectively to close the interior thereof;

an offset pipe having valve means therein adapted for connection to said outer pipe to form a communicating passageway to said annular space between said inner pipe and said outer pipe; and closing means insertable through said offset pipe and said communicating passageway to close said annular space between said inner and said outer pipes.

7. The apparatus as claimed in claim 6, wherein said closing means is a coil spring.

8. The apparatus as claimed in claim 7, wherein said spring is embedded in elastic material whereby when said spring is compressed said material expands to close said annular surface.

9. The apparatus as claimed in claim 6, wherein said closing means comprises a spiral flat spring adapted to first engage the inner wall of said outer pipe and to fill said annular space towards the outer wall of said inner pipe.

10. The apparatus as claimed in claim 6, wherein said closing means is a spiral flat spring adapted to first engage the outer wall of said inner pipe and to fill said annular space towards the inner wall of said outer pipe.

11. The apparatus of claim 6 wherein said rod-like members are each provided with a tip portion, said tip portion being angularly formed, the sum of the angles of said tip portion of said plurality of rod members being equal to 360° whereby the interior of said inner pipe is closed when said rods are inserted therein.

12. In a method for extinguishing oil well fires which wells have an inner pipe and an outer casing separated by an annular space, the steps which include: inserting in a common horizontal plane at least three drills at equal radial spacings through the walls of both the pipe and the casing, the drills having interfitting inner ends which when placed in side-by-side relationship form a continuous wall equal to the internal cross section of said inner pipe and closing the same against the passage of oil or gas through said pipe, inserting a valved pipe through the casing between said drills and the lower end of said casing; inserting means through said pipe into said annular space to gradually fill said space between said pipe and casing to form a seal therein against the passage of oil or gas therethrough.

* * * * *